US009871297B2

(12) United States Patent
Kitchener

(10) Patent No.: US 9,871,297 B2
(45) Date of Patent: Jan. 16, 2018

(54) PATCH ANTENNA ELEMENT

(71) Applicants: ACE TECHNOLOGIES CORPORATION, Incheon (KR); ACEAXIS LIMITED, Buckinghamshire (GB)

(72) Inventor: Dean Kitchener, Buckinghamshire (GB)

(73) Assignee: ACE TECHNOLOGIES CORPORATION, Incheon (KR)

( * ) Notice: Subject to any disclaimer, the term of this patent is extended or adjusted under 35 U.S.C. 154(b) by 558 days.

(21) Appl. No.: 14/367,094

(22) PCT Filed: Dec. 18, 2012

(86) PCT No.: PCT/KR2012/011098
§ 371 (c)(1),
(2) Date: Jun. 19, 2014

(87) PCT Pub. No.: WO2013/094976
PCT Pub. Date: Jun. 27, 2013

(65) Prior Publication Data

US 2015/0349425 A1 Dec. 3, 2015

(30) Foreign Application Priority Data

Dec. 19, 2011 (GB) ..... 1121946.6

(51) Int. Cl.
*H01Q 9/04* (2006.01)
*H01Q 13/18* (2006.01)
*H01Q 1/24* (2006.01)

(52) U.S. Cl.
CPC ..... *H01Q 9/045* (2013.01); *H01Q 9/0435* (2013.01); *H01Q 13/18* (2013.01); *H01Q 1/246* (2013.01)

(58) Field of Classification Search
CPC ..... H01Q 9/045; H01Q 9/0435
See application file for complete search history.

(56) References Cited

U.S. PATENT DOCUMENTS 4,208,660 A 6/1980 McOwen, Jr.
4,320,402 A 3/1982 Bowen
(Continued)

FOREIGN PATENT DOCUMENTS

CN 1822438 A 8/2006
CN 201910487 U 7/2011
(Continued)

OTHER PUBLICATIONS

Wong H et al., Design of Dual-Polaraized L-Probe Patch Antenna Arrays with High Isglation, IEEE Transactions on Antennas and Propagation, IEEE Service Center, Piscataway, NJ, US, vo. 52, No. 1, Jan. 1, 2004 (Jan. 1, 2004), pp. 45-52, XP0O1046269.
(Continued)

*Primary Examiner* — Jessica Han
*Assistant Examiner* — Amal Patel
(74) *Attorney, Agent, or Firm* — TechLaw LLP

(57) ABSTRACT

An antenna element for transmission and/or reception of signals within a frequency band comprises a ground plane (4), a patch radiator (2), a connection point (14*a*) for connection of the antenna element to a feed network and a probe (8*a*) having two ends. The probe (8*a*) is located between the ground plane (4) and the patch radiator (2) and the patch radiator (2) is disposed in a parallel relationship with the ground plane (4) to form a resonant cavity between the patch radiator (4) and the ground plane (2). The antenna element comprises a transmission line (10*a*) which is disposed in a parallel relationship with the ground plane (4) and the transmission line (10*a*) is connected to an end (9*a*) of the probe (8*a*) and is arranged to have a length such that an
(Continued)

impedance at the end (9*a*) of the probe is transformed. The transmission line (10*a*) is contained within the resonant cavity between the patch radiator (2) and the ground plane (4).

16 Claims, 5 Drawing Sheets

(56) References Cited

U.S. PATENT DOCUMENTS

| | | | | |
|---|---|---|---|---|
| 4,821,040 | A * | 4/1989 | Johnson | H01Q 1/3275 343/700 MS |
| 4,924,236 | A | 5/1990 | Schuss et al. | |
| 5,165,109 | A | 11/1992 | Han et al. | |
| 5,465,100 | A | 11/1995 | Remondiere et al. | |
| 5,861,848 | A | 1/1999 | Iwasaki | |
| 6,359,588 | B1 * | 3/2002 | Kuntzsch | H01Q 9/0407 343/700 MS |
| 8,854,265 | B1 * | 10/2014 | Yang | H01Q 9/045 343/700 MS |
| 2010/0141532 | A1 | 6/2010 | Uddin et al. | |

FOREIGN PATENT DOCUMENTS

| | | | |
|---|---|---|---|
| EP | 0278070 | A1 | 8/1988 |
| EP | 0537548 | A1 | 9/1992 |
| FR | 2627636 | A1 | 2/1988 |
| KR | 10-2006-0101370 | A | 9/2006 |
| KR | 10-2009-0028355 | A | 3/2009 |
| KR | 10-2009-008597 | A | 8/2009 |
| KR | 10-2009-0093195 | A | 9/2009 |

OTHER PUBLICATIONS

Search Report issued from Great Britain Patent Application No. GB1121946.6, dated May 2, 2012.

International Search Report issued from PCT International Application No. PCT/KR2012/011098, dated Feb. 21, 2013.

* cited by examiner

PATCH ANTENNA ELEMENT

TECHNICAL FIELD

The present invention relates generally to an antenna element, and more 5 specifically, but not exclusively, to a dual polar probe-fed patch antenna element.

BACKGROUND ART

Modern wireless communications systems place great demands on the 10 antennas used to transmit and receive signals, especially at cellular wireless base stations. Antennas are required to produce a carefully tailored radiation pattern with a defined beamwidth in azimuth, so that, for example, the wireless cellular coverage area has a controlled overlap with the coverage area of other antennas. The antennas may be deployed, for example, in a tri-cellular arrangement or, 15 with a narrower beamwidth, as a six-sectored arrangement.

An antenna may comprise a single radiating structure in the form of an antenna element, or may comprise an array of antenna elements. Antenna elements may be used for reception or transmission of signals, or for both reception and transmission; an antenna element is typically reciprocal in 20 operation, that is to say it may receive or transmit with the same characteristics. An antenna element will typically be connected to a feed network having a specified terminating impedance, typically 50 Ohm, which may simply be a coaxial cable or printed track, for connecting the antenna element to other components in a radio system, such as a transmitter or receiver.

Typically cellular wireless systems employ polarisation diversity, so that it is generally required that each antenna element is capable of transmitting and receiving components of signals having orthogonal polarisations. Typically an antenna element will be arranged to receive linearly polarised components at nominally +45 degrees and −45 degrees to vertical, and each antenna elements 30 will typically have a separate feed network for signals of each polarisation.

A well known type of antenna element is the probe-fed patch antenna. Such antenna elements typically employ a radiating patch in the form of a circular or rectangular metallic conductor, which is connected to the feed network by a probe in the form of a metallic conductor. The probe is connected 5 to the patch at a feed point chosen to optimise the radiation properties for a given application. For a dual polar patch antenna element, two probes are used, each connected to the respective feed network for the polarisation, and connected to the patch at a respective feed point that will excite the desired polarisation. Typically, a probe-fed patch antenna element comprises a resonant 10 cavity formed between the patch and a ground plane. The probe may conventionally pass through the cavity for connection to a feed network on the opposite side of the ground plane from the patch.

Typically, a probe-fed patch antenna has an impedance comprising an inductive reactance, when measured at the probe. In order to connect the patch 15 to the feed network, some form of impedance matching network is typically required. This may take the form of a capacitive coupling between the probe and the patch to compensate for the reactive element of the impedance, but, depending on various factors including the size of the cavity, a transformation of real, that is to say resistive, impedance may also be required.

In some applications, such as for small base stations intended to in-fill gaps in coverage of macro-cellular base stations, it is important to constrain the size of the antenna element, in particular in terms of thickness measured perpendicular to the patch. In such an application, it may be required to use a shallow cavity, but this may require impedance matching of both complex, that 25 is to say reactive, and real, that is to say resistive, parts of the impedance of the patch to the impedance of the feed network. Resistive matching may be accomplished by an impedance matching network incorporating a transmission line of an appropriate length, but the accommodation of such a network between the probe and the connection point to the feed network will typically add to the 30 size of the antenna element, counteracting the benefit of the shallowness of the cavity.

DISCLOSURE

Technical Problem

It is an object of the invention to address at least some of the limitations of the prior art systems.

Technical Solution

In accordance with a first aspect of the present invention, there is provided an antenna element for transmission and/or reception of signals within a frequency band, the antenna element comprising a ground plane, a patch radiator, a connection point for connection of the antenna element to a feed network having a terminating impedance, and a probe having two ends, the 10 probe being located between the ground plane and the patch radiator, the patch radiator being disposed in a parallel relationship with the ground plane to form a resonant cavity between the patch radiator and the ground plane, wherein the antenna element comprises a transmission line disposed in a parallel relationship with the ground plane, wherein the transmission line is 15 connected to an end of the probe and arranged to have a length such that an impedance at said end of the probe is transformed, and wherein the transmission line is contained within the resonant cavity between the patch radiator and the ground plane.

An advantage of containing the transmission line within the resonant 20 cavity between the patch radiator and the ground plane is that there is no need to increase the size of the antenna element to accommodate the transmission line outside the resonant cavity. The transmission line may typically be formed of a microstrip line, for example as a track on a printed circuit board or as a metallic strip, in either case with the ground plane of the antenna element acting as the 25 ground plane for the transmission line. However, a microstrip line would be expected to radiate, and also to pick up interference, from the side opposite the ground plane, as it is not shielded. The patch radiator would also be expected to radiate and receive interference. Therefore, a skilled person would expect there to be interaction between the transmission line and the patch radiator if the 30 transmission line were to be cited in the cavity, and indeed the resonant properties of the resonant cavity may be expected to be affected by the presence of the transmission line. It is conventional to design radio frequency circuit parts, such as the cavity and transmission line, separately, and to contain each in a screened compartment, especially if the parts are expected to radiate, in order to simply the design process and to avoid unwanted interactions. Therefore, a 5 skilled person would be unlikely to consider containing the transmission line within the resonant cavity. However, it has been found that, contrary to expectations, an antenna element designed according to this approach performs well, having a good input match and a well-controlled radiation pattern.

In an embodiment of the invention, the probe has one end connected to 10 the patch radiator and another end providing a feed point of the patch radiator, and the transmission line is arranged to connect the feed point of the patch radiator to the connection point. This has an advantage that the transmission line may transform the impedance of the feed point as measured at the connection point.

In an embodiment of the invention, the transmission line is arranged to transform the impedance at the feed point of the patch radiator to give an impedance at the connection point that is closer to the terminating impedance of the feed network, measured at a frequency within the frequency band. This has an advantage that the impedance at the terminating point may be, at least 20 approximately, matched to the terminating impedance of the feed network, even for cases where the impedance at the feed point has a real component less that the terminating impedance.

In an embodiment of the invention, the length of the transmission line from the connection point to the feed point is in the range 0.2 to 0.5 wavelengths 25 at said frequency within the frequency band. This has been found to be an effective range of lengths for performing the impedance transformation between the feed point and the connection point.

In an embodiment of the invention the antenna element further comprises a matching stub of a determined length, one end of the matching stub 30 being connected to the transmission line at the connection point. Connecting a that an impedance transformation, further to the impedance transformation introduced by the transmission line, may be effected without requiring capacitive coupling may not be required at the feed point of the patch radiator. If the capacitive coupling is implemented by providing a non-conductive gap in 5 between a conductive connecting part of the patch radiator and a conductive radiating part of the patch radiator, then it may be necessary to construct the patch radiator from a composite material having conductive and non-conductive parts, such as a printed circuit board, which may be relatively expensive. If no such capacitive coupling is required, the patch radiator may simply be 10 implemented as a metal, for example aluminium or copper, sheet, which may be simpler and cheaper to manufacture.

In an embodiment of the invention the other end of the matching stub from the end connected to the transmission line is open circuit with respect to the ground plane. An advantage of using an open circuit is that no connection is 15 needed to the ground plane, which may simplify manufacture.

In an embodiment of the invention the length of the matching stub is arranged to provide a shunt capacitance, the shunt capacitance being arranged to transform the impedance at the connection point resulting from the transformation of the impedance at the feed point to the patch radiator by the 20 transmission line to a value closer to the terminating impedance of the feed network, measured at said frequency within the frequency band. This has been found to be an effective way to transform impedance.

In an embodiment of the invention the length of the transmission line is arranged to provide a transformation of the impedance at the feed point to a 25 value which may be transformed by the shunt capacitance to a value sufficiently close to the terminating value of the feed network to give better than 10 dB return loss. Reducing return loss of an antenna is advantageous in that a greater proportion of power is received or transmitted, and unwanted effects due to reflection are reduced.

In an embodiment of the invention the matching stub has a length in the range 0.1 to 0.3 wavelengths at said frequency, and the transmission line has a length in the range 0.30 to 0.5 wavelengths at said frequency. These values have been found to give particularly good impedance matching properties.

In an embodiment of the invention the transmission line has a length of substantially 0.39 wavelengths at said frequency. This value has been found to 5 be particularly advantageous.

In an embodiment of the invention, the other end of the matching stub from the end connected to the transmission line is short circuit with respect to the ground plane. This has an advantage that the length of the transmission line may be reduced, and thereby somewhat broader band operation may be 10 achieved.

In an embodiment of the invention the length of the matching stub is arranged to provide a shunt inductance, the shunt inductance being arranged to transform the impedance at the connection point resulting from the transformation of the impedance at the feed point of the patch radiator by the 15 transmission line to a value closer to the terminating impedance of the feed network, measured at said frequency within the frequency band.

In an embodiment of the invention, the length of the transmission line is arranged to provide a transformation of the impedance at the feed point to a value which may be transformed by the shunt inductance to a value sufficiently 20 close to the terminating value of the feed network to give better than 10 dB return loss.

In an embodiment of the invention the matching stub has a length in the range 0.05 to 0.2 wavelengths at said frequency, and the transmission line has a length in the range 0.2 to 0.4 wavelengths at said frequency. These values have 25 been found to be particularly advantageous.

In an embodiment of the invention the transmission line has a length of substantially 0.26 wavelengths at said frequency.

In an embodiment of the invention, the transmission line is coupled to the patch radiator by a capacitance. This has an advantage that a matching stub 30 may not be required at the connection point.

In an embodiment of the invention the patch radiator comprises a conductive connecting part separated by a non-conductive part from a conductive radiating part, said feed point being on the connecting part, and said capacitance is provided by capacitance between the connecting part and the 5 radiating part. This has an advantage that a capacitance with good radio frequency properties may be implemented economically.

In an embodiment of the invention said capacitance is arranged to provide an impedance at the feed point of the patch radiator, such that, when the impedance at the feed point of the patch radiator is transformed to give an 10 impedance at the connection point by the transmission line, the impedance at the connection point is closer to the terminating impedance of the feed network, measured at said frequency within the frequency band, than would have been the case with a direct coupling between the feed point and the radiating part of the patch radiator. This has an advantage that a good impedance match may be 15 achieved.

In an embodiment of the invention said capacitance is arranged to substantially cancel a reactive part of the impedance at the feed point at said frequency within the frequency band. This has an advantage that a transmission line may be use to transform the resulting impedance to close to the terminating 20 impedance.

In an embodiment of the invention the transmission line has a length in a range 0.2 to 0.3 wavelengths at said frequency within the frequency band. This has been found to be a particularly effective range of values.

In an embodiment of the invention the transmission line has a length of 25 substantially a quarter wavelength at said frequency within the frequency band. This has been found to be a particularly effective value.

In an embodiment of the invention the transmission line has a characteristic impedance arranged to transform a real part of the impedance value at the feed point to a value closer to that of the terminating impedance of 30 the feed network, when measured at the connection point. This value of impedance gives an effective transformation.

In an embodiment of the invention, the characteristic impedance of the transmission line is in the range 30-40 Ohms. This has been found to be a particularly effective value.

In an embodiment of the invention, the antenna element further 5 comprises a conductive barrier connected to the ground plane and perpendicular to the ground plane, the conductive barrier being arranged to form walls of enclosure defining the resonant cavity, the enclosure having a top face defined by the patch radiator and a bottom face defined by the ground plane, there being a non-conductive gap provided between the periphery of the patch radiator and 10 the barrier.

In an embodiment of the invention, the patch radiator is substantially circular.

In an embodiment of the invention, the patch radiator is substantially rectangular. An advantage of a rectangular patch radiator is that it may typically 15 result in a rectangular outline for the antenna element, which may be convenient for packaging with other rectangular equipment.

In an embodiment of the invention, the transmission line is formed from a metallic strip. This has an advantage that the transmission line may be convenient to manufacture, and the transmission line may have a dielectric that 20 is predominantly air, which may exhibit less loss than a solid dielectric.

In an embodiment of the invention, the transmission line is formed as a track on a printed circuit board. This has an advantage that the transmission line may be convenient to manufacture.

In an embodiment of the invention, the transmission line is supported in 25 the parallel relationship with the ground plane by non-conductive spacers. This is a convenient way of producing a transmission line with a controlled impedance and low loss.

In an embodiment of the invention, the probe is disposed in a perpendicular relationship to the patch radiator.

In an embodiment of the invention, the probe is formed from a metallic strip integral to the transmission line. This has an advantage that a soldered connection may not be required between the probe and the transmission line.

In an embodiment of the invention, the antenna element is a dual polar 5 antenna element, the antenna element comprising: a second connection point for connection of the antenna element to a second feed network having the terminating impedance, and a second probe having two ends, the second probe being located between the ground plane and the patch radiator, wherein the antenna element comprises a second transmission line disposed in a parallel relationship with the ground plane, wherein the second transmission line is connected to an end of the second probe and arranged to have a length such that an impedance at said end of the second probe is transformed, and wherein both the first and the second transmission lines are contained within the resonant cavity between the patch radiator and the ground plane.

This has an advantage that a single patch may be used to transmit or receive at two polarisations. It is not obvious to contain both the first and second transmission lines within the resonant cavity, since it may be expected 20 that coupling between the transmission lines would reduce cross-polar isolation. However, it has been found that cross-polar isolation resulting from this approach is typically within an acceptable range.

Further features and advantages of the invention will be apparent form the following description of preferred embodiments of the invention, which are 25 given by way of example only.

Advantageous Effects

An advantage of containing the transmission line within the resonant 20 cavity between the patch radiator and the ground plane is that there is no need to increase the size of the antenna element to accommodate the transmission line outside the resonant cavity. Additionally, the antenna element performs well, having a good input match and a well-controlled radiation pattern.

BRIEF DESCRIPTION OF DRAWINGS

Example embodiments of the present invention will become more apparent by describing in detail example embodiments of the present invention with reference to the accompanying drawings, in which.

DETAILED DESCRIPTION

Figure 1:
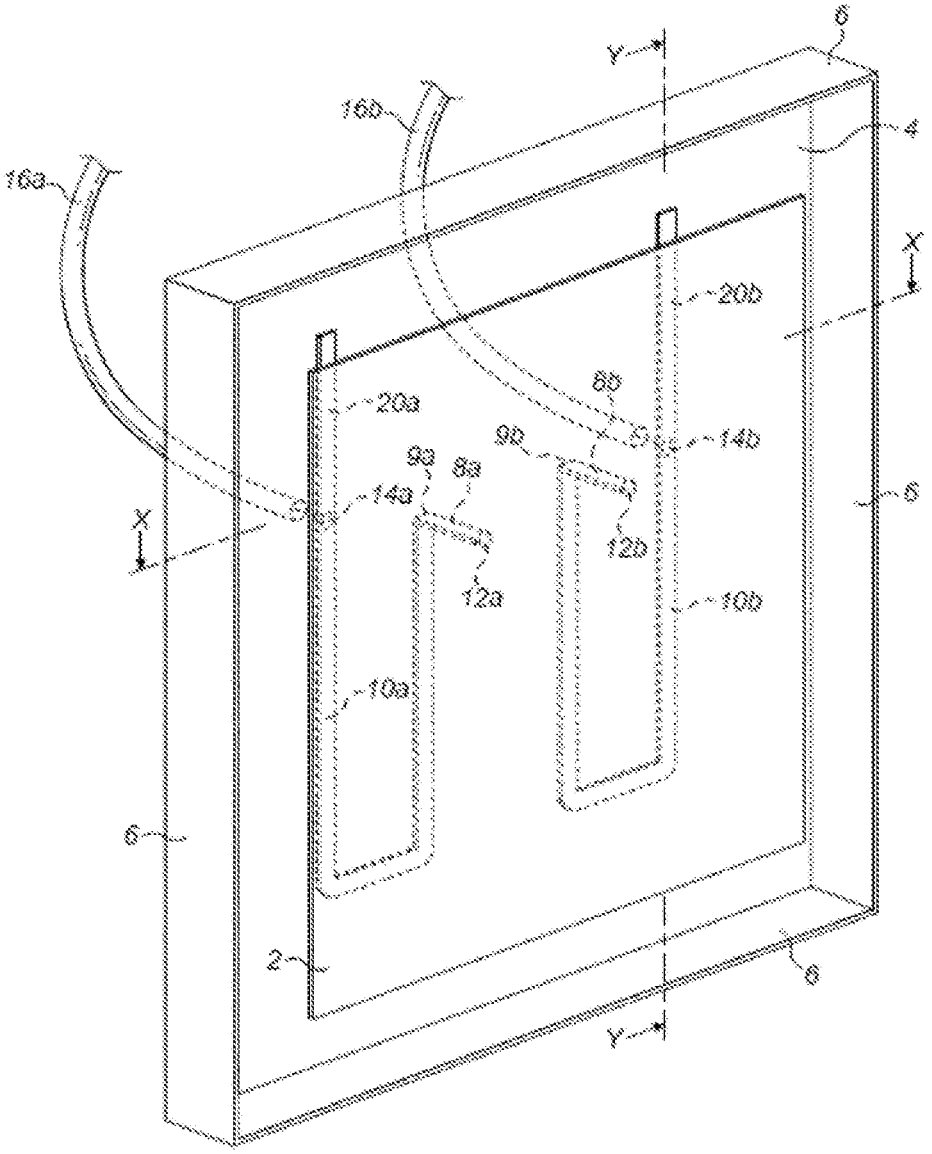
FIG. 1 is a diagram showing an oblique view of a dual polar antenna element having a rectangular patch radiator in an embodiment of the invention.

Hereinafter, embodiments of the present invention will be described in detail with reference to accompanying drawings.

By way of example, embodiments of the invention will now be described in the context of a probe-fed dual polar patch antenna element, for use in a cellular wireless system at carrier frequencies operating at approximately 700 MHz within a 12% bandwidth. However, it will be understood that this is by way of example only and that other embodiments may involve operation in the 25 range 500 MHz to 3 GHz, or at a frequencies outside this range, and the bandwidth may be higher or lower than the bandwidth of the embodiment described. Embodiments are not limited to use with a particular type of wireless system. Antenna elements may be used singly, or as part of an array of antenna elements. An antenna element need not be dual polar; embodiments of the 30 invention include single polar antenna elements.

In a conventional design of probe-fed patch antenna, the probe passes from a feed point of the patch antenna through the cavity formed between the patch radiator and the ground plane for connection to a feed network on the opposite side of the ground plane. Typically the probe is connected to the radiating part of the patch radiator through a capacitance, which may be formed by a non-conducting gap between a connecting part of the patch antenna, typically a small disc, and a radiating part of the patch radiator. The capacitance may be sufficient to compensate for the inductance of the probe, so that a desired real impedance that is close to the standard terminating impedance of 50 Ohm that is widely used for wireless systems, for example by feed networks, may be achieved. It is important to match the impedance of radio frequency stages connected together in a radio frequency system, as this maximises power transfer between stages and minimises reflections. Return loss is a measure of reflected power from device when connected to a standard terminating impedance; it is typically desirable to minimise return loss by providing a good impedance match between devices. A return loss better than 10 dB, for example, may typically be specified for an antenna, meaning that less than 10% of power should be reflected from a connection point. If the thickness of a conventional probe-fed patch antenna element were reduced, the probe would, after the capacitive compensation, typically present an impedance with a real, that is to say resistive, component of impedance that is less than the standard terminating impedance of 50 Ohm. This is due mainly to the reduced clearance between the patch radiator and the ground plane.

In an embodiment of the invention, the thickness of a probe-fed patch antenna element is reduced, and the resulting low impedance is compensated for by using a length of transmission line contained within the cavity between the patch radiator and the ground plane. This saves on the extra height or width that would otherwise be needed to accommodate the transmission line if it were outside the cavity.

FIG. 1 shows an oblique view of a dual polar antenna element having a rectangular patch radiator 2 in an embodiment of the invention. The antenna element may be used for transmission and/or reception of signals within a frequency band, in this embodiment a 12% frequency band extending down to 698 MHz. In this embodiment, the antenna element is designed for use in a small base station, intended to in-fill gaps in coverage of macro-cellular base stations, and in this application in particular, the size of the antenna element is constrained, both in terms of thickness measured perpendicular to the patch, which is limited to about 25 mm, and in terms of area in plan view. Also in this embodiment, the antenna element is required to produce a beam in azimuth of approximately 120 degrees beamwidth.

As shown in FIG. 1, the antenna element comprises a ground plane 4, a patch radiator 2, two transmission lines 10*a*, 10*b* and two connection points 14*a*, 14*b* for connection of each transmission line to a feed network for respective channel to be received or transmitted by the antenna with a given polarisation. The patch radiator 2 is disposed in a parallel relationship with the ground plane 4 to form a resonant cavity between the patch radiator 2 and the ground plane 4, and each transmission line 10*a*, 10*b* is arranged in a parallel relationship with the ground plane. Each transmission line is arranged to connect a respective feed point 9*a*, 9*b* of the patch radiator, which may be an end of a respective probe 8*a*, 8*b*, to the respective connection point 14*a*, 14*b*. Each probe is connected to the patch radiator at the other end of the probe 12*a*, 12*b* from the end 9*a*, 9*b* acting as the feed point. Each transmission line 10*a*, 10*b* is arranged to have a length from the connection point 14*a*, 14*b* to the feed point 9*a*, 9*b* of the patch radiator 2 such that an impedance at the feed point of the patch radiator is transformed to give an impedance at the connection point that is closer, than is the impedance at the feed point, to the terminating impedance of the feed network, measured at a frequency within the frequency band, typically at a frequency approximately in the centre of the band. Alternatively, the impedance may be measured at several frequencies within the band, so that the impedance match is arranged to be optimised for the band, or so that no part of the band has an impedance match worse than a specified amount. For example, it may be specified that the return loss is less than 10 dB. As shown in FIG. 1, both transmission lines 10*a*, 10*b*, are contained within the resonant cavity between the patch radiator 2 and the ground plane 4.

FIG. 1 shows two coaxial cables 16*a*, 16*b*, which may form part of the feed network for each polarisation, which are connected to two connection points 14*a*, 14*b*. As may be seen in FIG. 1, a matching stub 20*a*, 20*b* is connected to each transmission line 10*a*, 10*b* at the respective connection point 14*a*, 14*b*. The matching stubs 20*a*, 20*b* provide an impedance transformation, further to the impedance transformation introduced by the transmission lines 10*a*, 10*b*, without requiring capacitive coupling for connection to the patch radiator, as would be required in a conventional patch antenna. In this embodiment of the invention the opposite end of the matching stubs from the end connected to the transmission line is open circuit with respect to the ground plane, so that no connection is needed to the ground plane as would be required for a short circuit; this may simplify manufacture. The length of the matching stub is arranged to provide a shunt capacitance. The value of shunt capacitance is selected to further transform the impedance at each connection point, further to the transformation of the impedance at the feed points to the patch radiator by the transmission line. As a result of the further transformation of impedance, the impedance at the connection points 14*a*, 14*b* is brought closer to the required terminating impedance, in this case 50 Ohm.

The impedance transformations effected by the transmission lines and the matching stubs may be designed to work in conjunction to produce the best match over an operating band. The length of each transmission line 10*a*, 10*b* is arranged to provide a transformation of the impedance at a respective feed point 9*a*, 9*b* to a value which may be transformed by the shunt capacitance to a value sufficiently close to the terminating value of the feed network to give better than 10 dB return loss.

In an embodiment of the invention the matching stubs have a length in the range 0.1 to 0.3 wavelengths at a frequency within the operating band, and the transmission lines have a length in the range 0.3 to 0.5 wavelengths. In the embodiment shown in FIG. 1, the transmission lines has a length of substantially 0.39 wavelengths, and the matching stubs have a length of approximately 0.2 wavelengths.

In the embodiment shown in FIG. 1, the ground plane has conductive walls 6 around the periphery, which provide electromagnetic shielding. The walls form a conductive barrier connected to the ground plane and perpendicular to the ground plane. The walls 6 form an enclosure defining the resonant cavity, the enclosure having a top face defined by the patch radiator and a bottom face defined by the ground plane. As can be seen in FIG. 1, there is a nonconductive gap provided between the periphery of the patch radiator 2 and the walls 6.

In the embodiment shown in FIG. 1, each transmission line 10*a*, 10*b* is formed from a metallic strip, for example the strip may be a copper or aluminium strip, which may be convenient to manufacture. The transmission line may have a dielectric that is predominantly air, which may exhibit less loss than a solid dielectric. Alternatively, the transmission line may be formed as a track on a printed circuit board.

In the embodiment shown in FIG. 1, each feed point of the patch radiator 9*a*, 9*b* is the end of a probe 8*a*, 8*b*, connected perpendicular to the patch radiator. As shown in FIG. 1, each probe 8*a*, 8*b* is formed from a metallic strip integral to the transmission line 10*a*, 10*b*. Alternatively, each probe may be a metallic rod, for example of diameter 1.5 mm, soldered to the respective transmission line 10*a*, 10*b* and the patch radiator 2.

Figure 2:
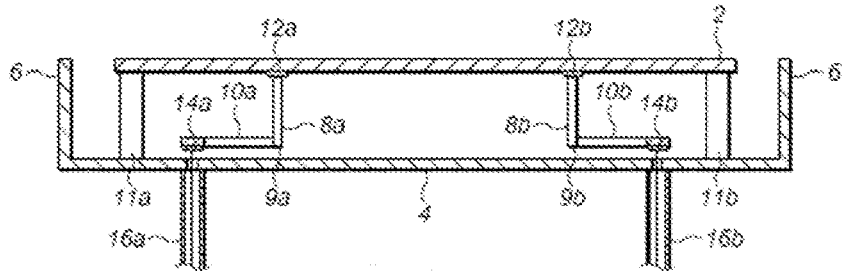
FIG. 2 is a diagram showing a cross-section of the dual polar antenna element of FIG. 1 through a section X-X according to an embodiment of the invention.

FIG. 2 shows a cross-section of the dual polar antenna element of FIG. 1 through a section X-X. This shows the probes 8*a*, 8*b* connected to the patch radiator 2, and a section through each transmission line at the connection points 14*a*, 14*b*, showing the connection to the coaxial cables 16*a*, 16*b*.

Figure 3:
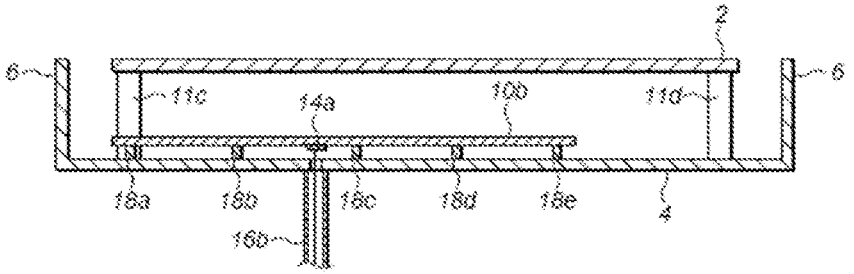
FIG. 3 is a diagram showing a cross-section of the dual polar antenna element of FIG. 1 through a section Y-Y according to an embodiment of the invention.

FIG. 3 shows a cross-section of the dual polar antenna element of FIG. 1 through a section Y-Y It can be seen that the transmission line 10*b* is supported in a parallel relationship with the ground plane by non-conductive spacers 18*a*, 18*b*, 18*c*, 18*d*, 18*e*. This is a convenient way of producing a transmission line with a controlled impedance and low loss.

Figure 4:
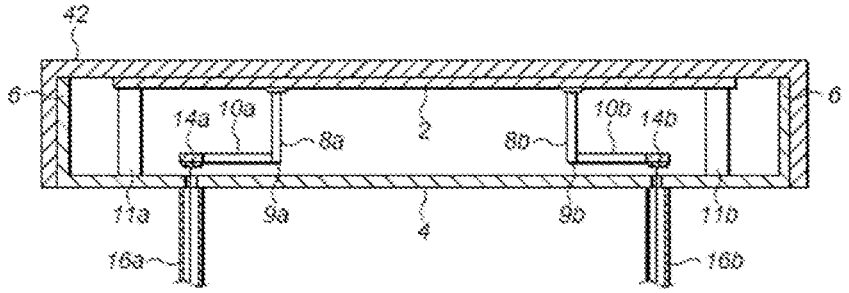
FIG. 4 is a diagram showing a cross-section of the dual polar antenna element with a non-conductive cover according to an embodiment of the invention.

FIG. 4 shows a cross-section of the dual polar antenna element of FIG. 1 through a section X-X, the dual polar antenna element having a nonconductive cover 42. The cover may be made from a polycarbonate material, and may serve to protect the antenna element from the outside environment.

Figure 5:
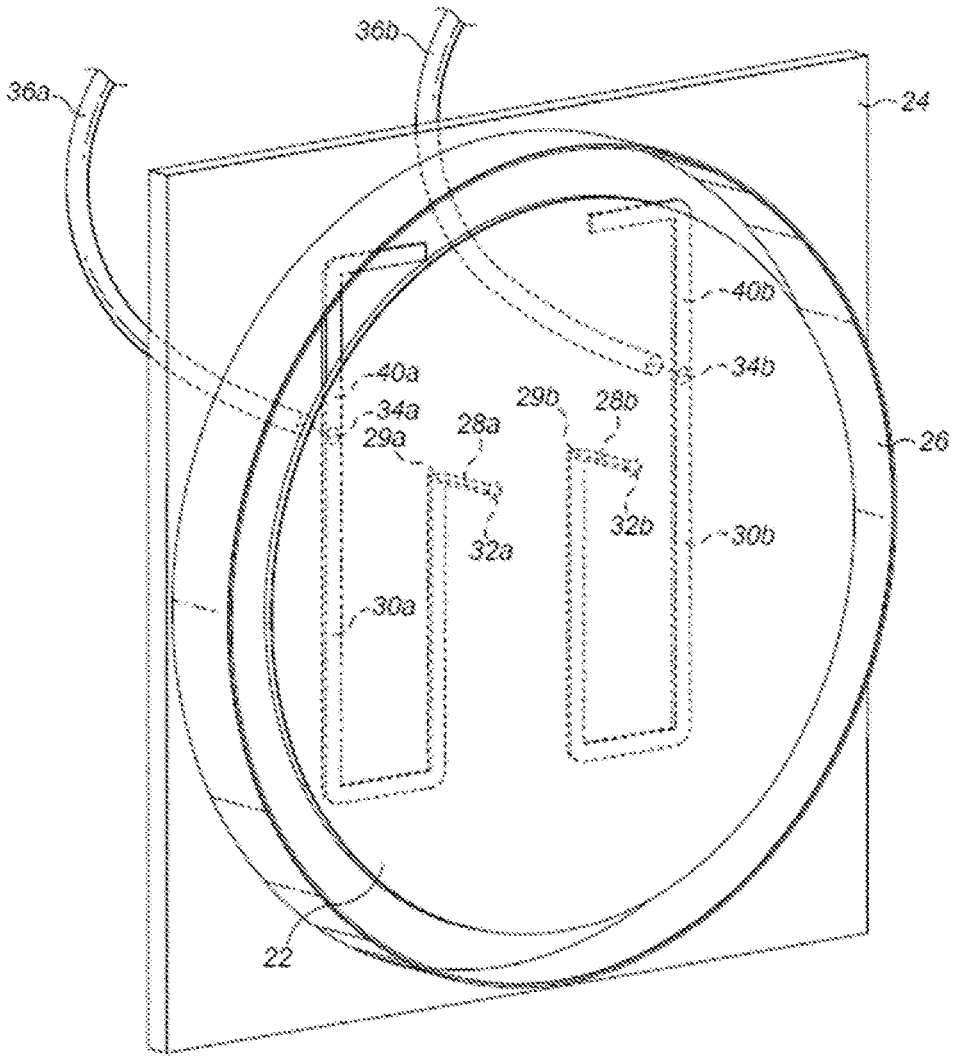
FIG. 5 is a diagram showing an oblique view of a dual polar antenna element having a circular patch radiator in an embodiment of the invention.

FIG. 5 shows an oblique view of a dual polar antenna element having a circular patch radiator 22 in an embodiment of the invention. As may be seen, the ground plane 24 may extend beyond the walls 26. The principle of operation is similar to that of the antenna element having a rectangular or square patch radiator shown in FIG. 1. The dimensions of the transmission lines 30*a*, 30*b*, open circuit stubs 40*a*, 40*b* and probes 28*a*, 28*b* each having one end 32*a*, 32*b* connected to the patch antenna and the other end 29*a*, 29*b* connected to the respective transmission line as a feed point for the patch radiator, are similar to those in FIG. 1. Coaxial cables 36*a*, 36*b* are connected to connection points 34*a*, 34*b* as in FIG. 1.

Figure 6:
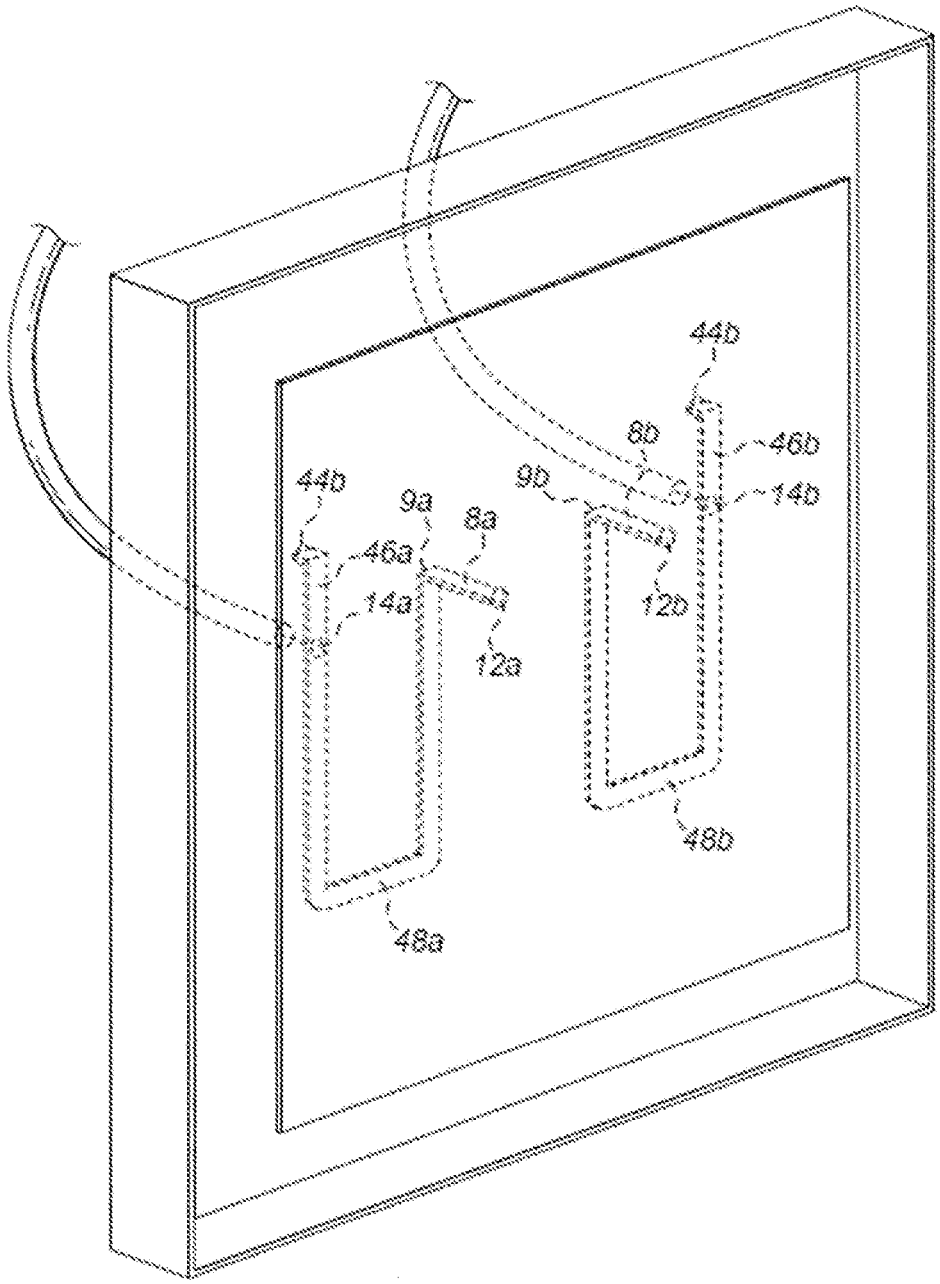
FIG. 6 is a diagram showing an oblique view of a dual polar antenna element having matching stubs with a short circuit termination in an embodiment of the invention.

FIG. 6 shows an oblique view of a dual polar antenna element having matching stubs 46*a*, 46*b* with a short circuit termination 44*a*, 44*b* in an embodiment of the invention. This is an alternative implementation to the use of stubs with open circuit terminations. This has an advantage that the length of the transmission lines 48*a*, 48*b* may be reduced, and thereby somewhat broader band operation may be achieved, but this may be at a cost of requiring solder connections between the matching stubs and the ground plane. The length of each matching stub 46*a*, 46*b* is arranged to provide a shunt inductance, the shunt inductance being arranged to transform the impedance at the respective connection point 14*a*, 14*b* resulting from the transformation of the impedance at the respective feed point 9*a*, 9*b* of the patch radiator by each respective transmission line 48*a*, 48*b* to a value closer to the terminating impedance of the feed network, measured at a frequency within the operating frequency band, or optimised at several points over the operating band. The length of each transmission line 48*a*, 48*b* is arranged to provide a transformation of the impedance at each respective feed point, in this case an end 9*a*, 9*b* of each probe 8*a*, 8*b*, to a value which may be transformed by the shunt inductance to a value sufficiently close to the terminating value of the feed network to give better than 10 dB return loss.

In an embodiment of the invention each matching stub 46*a*, 46*b* has a length in the range 0.05 to 0.2 wavelengths, and each transmission line 48*a*, 48*b* has a length in the range 0.2 to 0.4 wavelengths. In the embodiment shown in FIG. 6, each the transmission line 48*a*, 48*b* has a length of substantially 0.26 wavelengths, and the matching stubs 46*a*, 46*b* have a length of approximately 0.1 wavelengths.

Figure 7:
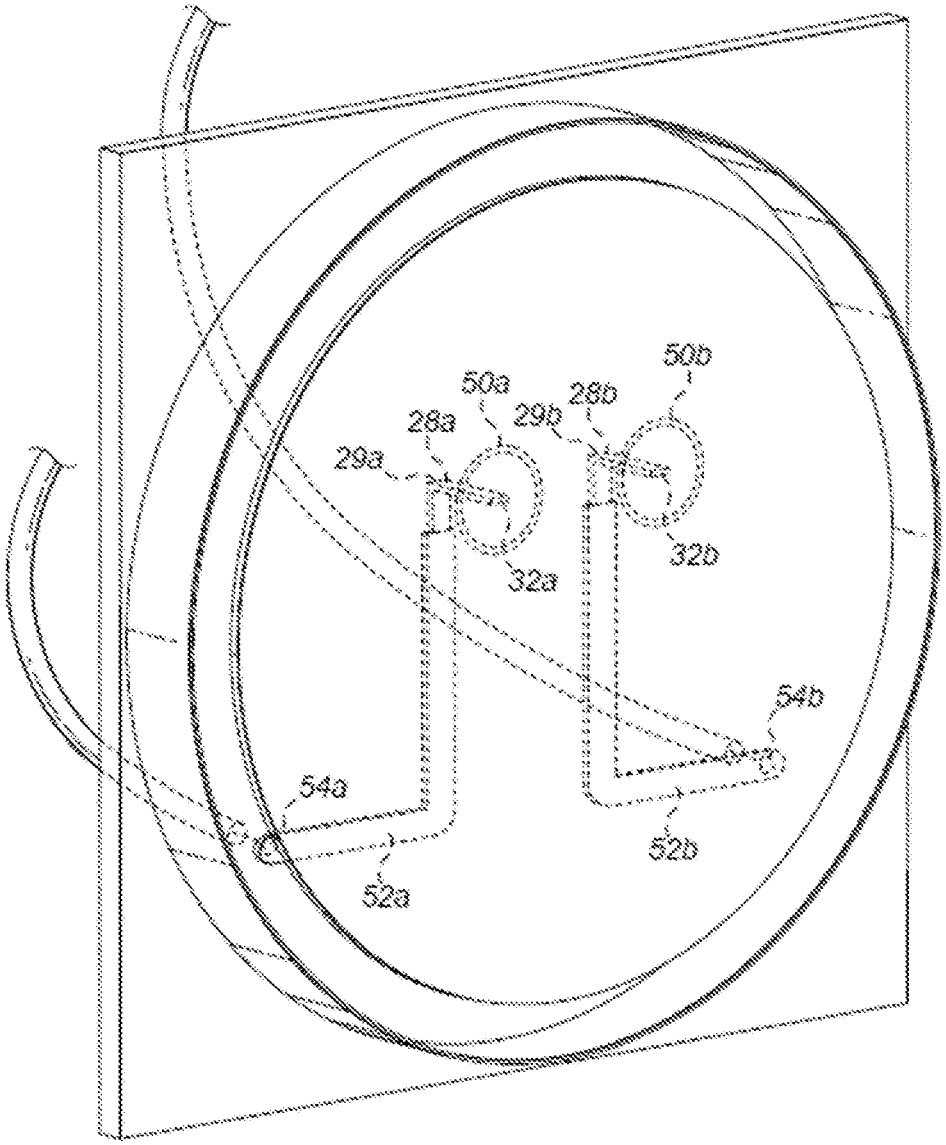
FIG. 7 is a diagram showing an oblique view of a dual polar antenna element having capacitive connection between probes and the patch radiator in an embodiment of the invention.

FIG. 7 shows an oblique view of a dual polar antenna element having capacitive connection between probes 28*a*, 28*b* and the patch radiator. In this alternative embodiment, each transmission line 52*a*, 52*b* is coupled to the patch radiator by the capacitance of the capacitive connection. This has an advantage that matching stubs may not be required at the connection points 54*a*, 54*b*. In this embodiment of the invention the patch radiator comprises a conductive connecting part separated by a non-conductive part 50*a*, 50*b* from a conductive radiating part. Each feed point 29*a*, 29*b* that is connected to the respective transmission line 52*a*, 52*b* is one end of a respective probe 28*a*, 28*b*, and each respective probe is connected to the respective connecting part of the patch radiator at the other end 32*a*, 32*b* of the probe. The capacitance is provided by capacitance between the connecting part and the radiating part of the patch radiator. This provides a capacitance with good radio frequency properties.

In an embodiment of the invention the capacitance is arranged to provide an impedance at each feed point 29*a*, 29*b* of the patch radiator, such that, when the impedance at each feed point of the patch radiator is transformed to give an impedance at the respective connection point 54*a*, 54*b* by the respective transmission line 52*a*, 52*b*, the impedance at each connection point 54*a*, 54*b* is closer to the terminating impedance of the feed network than would have been the case with a direct coupling between the feed point and the radiating part of the patch radiator. The capacitance may be arranged to substantially cancel a reactive part of the impedance at each feed point at a frequency within the frequency band. In an embodiment of the invention each transmission line 52*a*, 52*b* has a length in a range 0.2 to 0.3 wavelengths. In the embodiment of the invention shown in FIG. 7, each transmission line 52*a*, 52*b* has a length of substantially a quarter wavelength. Each transmission line has a characteristic impedance arranged to transform a real part of the impedance value at the respective feed point 28*a*, 28*b* to a value closer to that of the terminating impedance of the feed network, when measured at the respective connection point 54*a*, 54*b*. In an embodiment of the invention, the characteristic impedance of the transmission line is in the range 30-40 Ohms. In the embodiment of the invention shown in FIG. 7, the impedance is approximately 35 Ohms.

In each of the embodiments described in connection with FIGS. 1 to 7, a single polar antenna element may be realised by, for example, omitting the probe, transmission line and connection point components used for one of the polarisations of the dual polar antenna element.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An antenna element for transmission and/or reception of signals within a frequency band, the antenna element comprising a ground plane, a patch radiator, a connection point for connection of the antenna element to a feed network having a terminating impedance, and a probe having two ends, the probe being located between the ground plane and the patch radiator, the patch radiator being disposed in a parallel relationship with the ground plane to form a resonant cavity between the patch radiator and the ground plane, wherein the antenna element comprises a transmission line disposed in a parallel relationship with the ground plane, wherein the transmission line is connected to an end of the probe and arranged to have a length such that an impedance at said end of the probe is transformed, and wherein the transmission line is contained within the resonant cavity between the patch radiator and the ground plane, wherein the antenna element further comprises a matching stub of a determined length, one end of the matching stub being connected to the transmission line at the connection point, wherein the other end of the matching stub from the end connected to the transmission line is open circuit with respect to the ground plane, and wherein, wherein the antenna element further comprises a conductive barrier connected to the ground plane and perpendicular to the ground plane, the conductive barrier being arranged to form walls of enclosure defining the resonant cavity, the enclosure having a top face defined by the patch radiator and a bottom face defined by the ground plane, there being a non-conductive gap provided between the periphery of the patch radiator and the barrier.

2. An antenna element according to claim 1, wherein the probe has one end connected to the patch radiator and another end providing a feed point of the patch radiator, and wherein the transmission line is arranged to connect the feed point of the patch radiator to the connection point.

3. An antenna element according to claim 2, wherein the transmission line is arranged to transform the impedance at the feed point of the patch radiator to give an impedance at the connection point that is closer to the terminating impedance of the feed network, measured at a frequency within the frequency band.

4. An antenna element according to claim 3, wherein the length of the transmission line from the connection point to the feed point is in the range 0.2 to 0.5 wavelengths at said frequency within the frequency band.

5. An antenna element according to claim 1, wherein the length of the matching stub is arranged to provide a shunt capacitance, the shunt capacitance being arranged to transform the impedance at the connection point resulting from the transformation of the impedance at the feed point to the patch radiator by the transmission line to a value closer to the terminating impedance of the feed network, measured at said frequency within the frequency band.

6. An antenna element according to claim 5, wherein the length of the transmission line is arranged to provide a transformation of the impedance at the feed point to a value which may be transformed by the shunt capacitance to a value sufficiently close to the terminating value of the feed network to give better than 10 dB return loss.

7. An antenna element according to claim 1, wherein the matching stub has a length in the range 0.1 to 0.3 wavelengths at said frequency, and the transmission line has a length in the range 0.30 to 0.5 wavelengths at said frequency.

8. An antenna element according to claim 7, wherein the transmission line has a length of substantially 0.39 wavelengths at said frequency.

9. An antenna element according to claim 1, wherein the patch radiator is substantially circular.

10. An antenna element according to claim 1, wherein the patch radiator is substantially rectangular.

11. An antenna element according to claim 1, wherein the transmission line is formed from a metallic strip.

12. An antenna element according to claim 1, wherein the transmission line is formed as a track on a printed circuit board.

13. An antenna element according to claim 1, wherein the transmission line is supported in the parallel relationship with the ground plane by non-conductive spacers.

14. An antenna element according to claim 1, wherein the probe is disposed in a perpendicular relationship to the patch radiator.

15. An antenna element according to claim 1, wherein the probe is formed from a metallic strip integral to the transmission line.

16. An antenna element according to claim 1, wherein the antenna element is a dual polar antenna element, the antenna element comprising:

a second connection point for connection of the antenna element to a second feed network having the terminating impedance, and a second probe having two ends, the second probe being located between the ground plane and the patch radiator, wherein the antenna element comprises a second transmission line disposed in a parallel relationship with the ground plane, wherein the second transmission line is connected to an end of the second probe and arranged to have a length such that an impedance at said end of the second probe is transformed, and wherein both the first and the second transmission lines are contained within the resonant cavity between the patch radiator and the ground plane.

* * * * *